US011701670B2

(12) United States Patent
Stewart et al.

(10) Patent No.: US 11,701,670 B2
(45) Date of Patent: Jul. 18, 2023

(54) SPRAY TIP

(71) Applicant: Graco Minnesota Inc., Minneapolis, MN (US)

(72) Inventors: Samuel R. Stewart, Minneapolis, MN (US); Robert W. Kinne, Columbia Heights, MN (US)

(73) Assignee: Graco Minnesota Inc.

( * ) Notice: Subject to any disclaimer, the term of this patent is extended or adjusted under 35 U.S.C. 154(b) by 260 days.

(21) Appl. No.: 17/100,134

(22) Filed: Nov. 20, 2020

(65) Prior Publication Data

US 2021/0229113 A1 Jul. 29, 2021

Related U.S. Application Data

(60) Provisional application No. 62/966,003, filed on Jan. 26, 2020.

(51) Int. Cl.

| | |
|---|---|
| ***B05B 1/04*** | (2006.01) |
| ***B05B 15/534*** | (2018.01) |
| ***B05B 9/01*** | (2006.01) |

(52) U.S. Cl.

CPC ..... *B05B 1/048* (2013.01); *B05B 9/01* (2013.01); *B05B 15/534* (2018.02)

(58) Field of Classification Search

CPC ..... B05B 15/534; B05B 1/048; B05B 1/046; B05B 1/341; B05B 9/01

See application file for complete search history.

(56) References Cited

U.S. PATENT DOCUMENTS

| | | | | |
|---|---|---|---|---|
| 3,000,576 A | | 9/1961 | Levey et al. | |
| 3,202,360 A | | 8/1965 | O'Brien | |
| 3,930,619 A | * | 1/1976 | Levey | B05B 1/3046 239/533.13 |
| 4,097,000 A | * | 6/1978 | Derr | B05B 1/042 239/599 |
| 4,128,206 A | | 12/1978 | Bintner | |
| 4,349,156 A | | 9/1982 | Haruch et al. | |
| 5,505,381 A | * | 4/1996 | Torntore | B05B 15/534 239/119 |
| 5,699,967 A | | 12/1997 | Conatser et al. | |

(Continued)

FOREIGN PATENT DOCUMENTS

| | | |
|---|---|---|
| DE | 2506811 A1 | 8/1975 |
| EP | 1577015 A2 | 9/2005 |

(Continued)

OTHER PUBLICATIONS

International Search Report and Written Opinion for PCT Application No. PCT/US2020/061547, dated Mar. 19, 2021, pp. 12.

(Continued)

*Primary Examiner* — Tuongminh N Pham

(74) *Attorney, Agent, or Firm* — Kinney & Lange, P.A.

(57) ABSTRACT

A spray tip is configured to atomize thick, viscous fluids. The spray tip includes a pre-orifice piece having an inlet orifice that defines a first restriction in a fluid path through the spray tip. The spray tip also includes a tip piece having an outlet orifice that defines a second restriction in the fluid path. The first and second restrictions are the portions of the fluid path having the smallest flow areas. A cross-sectional area of the outlet orifice is greater than a cross-sectional area of the inlet orifice.

15 Claims, 9 Drawing Sheets

(56) References Cited

U.S. PATENT DOCUMENTS

| | | | | |
|---|---|---|---|---|
| 7,552,881 | B2 | 6/2009 | Lipthal et al. | |
| 8,814,070 | B2 | 8/2014 | Drozd et al. | |
| 9,675,982 | B2 | 6/2017 | Becker et al. | |
| 10,525,486 | B2 | 1/2020 | Becker et al. | |
| 2005/0205695 | A1 | 9/2005 | Geskin et al. | |
| 2016/0228883 | A1 | 8/2016 | Becker et al. | |
| 2016/0303585 | A1* | 10/2016 | Wenzel | B05B 1/34 |
| 2018/0178228 | A1 | 6/2018 | Kinne et al. | |
| 2018/0185855 | A1 | 7/2018 | Wenzel et al. | |
| 2019/0283054 | A1 | 9/2019 | Rossner et al. | |

FOREIGN PATENT DOCUMENTS

| | | | |
|---|---|---|---|
| GB | 1493326 | A | 11/1977 |
| GB | 2081606 | A | 2/1982 |

OTHER PUBLICATIONS

International Preliminary Report on Patentability for PCT Application No. PCT/US2020/061547, dated Aug. 4, 2022, pp. 9.
First Chinese Office Action for CN Application No. 202080094387.5, dated Mar. 30, 2023, pp. 18.

* cited by examiner

SPRAY TIP

CROSS-REFERENCE TO RELATED APPLICATION(S)

This application claims the benefit of U.S. Provisional Application No. 62/966,003 filed Jan. 26, 2020 for "SPRAY TIP," the disclosure of which is hereby incorporated by reference in its entirety.

BACKGROUND

The present invention relates generally to fluid spraying systems. More specifically, the present invention relates to a spray tip.

Fluid spraying systems are commonly used in a wide variety of applications, from industrial assembly to home painting. Hand controlled sprayers can be used by a human operator, while automated sprayers are typically used in mechanized manufacturing processes. Fluid sprayed by such systems conforms to a spray pattern defined, in large part, by aperture shape and size.

SUMMARY

According to one aspect of the disclosure, a spray tip for spraying fluid includes a body having a tip bore extending transversely through the body; a pre-orifice piece located within the tip bore, the pre-orifice piece having an inlet orifice; and a tip piece located within the tip bore. The tip piece is located in a downstream direction along the tip bore relative to the pre-orifice piece. The tip piece has an outlet orifice configured to atomize fluid into a spray fan. The tip piece and the pre-orifice piece together form at least part of a fluid path extending through the tip bore. The inlet orifice and the outlet orifice define the two smallest flow area portions of the fluid path. A cross-sectional area of the inlet orifice is less than a cross-sectional area of the outlet orifice.

According to an additional or alternative aspect of the disclosure, a method of spraying includes driving fluid in a downstream direction through a fluid path defined within a tip bore of a spray tip; restricting flow through the tip bore with an inlet orifice formed in a pre-orifice piece defining at least a portion of the fluid path, wherein the inlet orifice is disposed at a first axial location within the tip bore; and restricting flow through the tip bore with an outlet orifice formed in a tip piece defining at least a portion of the fluid path, wherein the outlet orifice is disposed at a second axial location within the tip bore. The second axial location is spaced in the downstream direction from the first axial location. A cross-sectional area of the inlet orifice is less than a cross-sectional area of the outlet orifice.

DETAILED DESCRIPTION

The present invention is directed to a spray tip assembly with an upstream chamber piece and a downstream chamber piece. The downstream chamber piece and upstream chamber piece cooperate to form a turbulating chamber between an inlet orifice and an outlet orifice. The outlet orifice is larger than the inlet orifice. The disclosed spray tip can spray thick, viscous fluids such as epoxies. Thick, viscous fluids are particularly difficult to atomize in a spray fan. Aspects of the present disclosure facilitate atomization of such thick, viscous fluids. While epoxy will be used herein as an exemplar, it will be understood that this is merely one example and that other fluids can be sprayed instead of paint.

Figure 1:
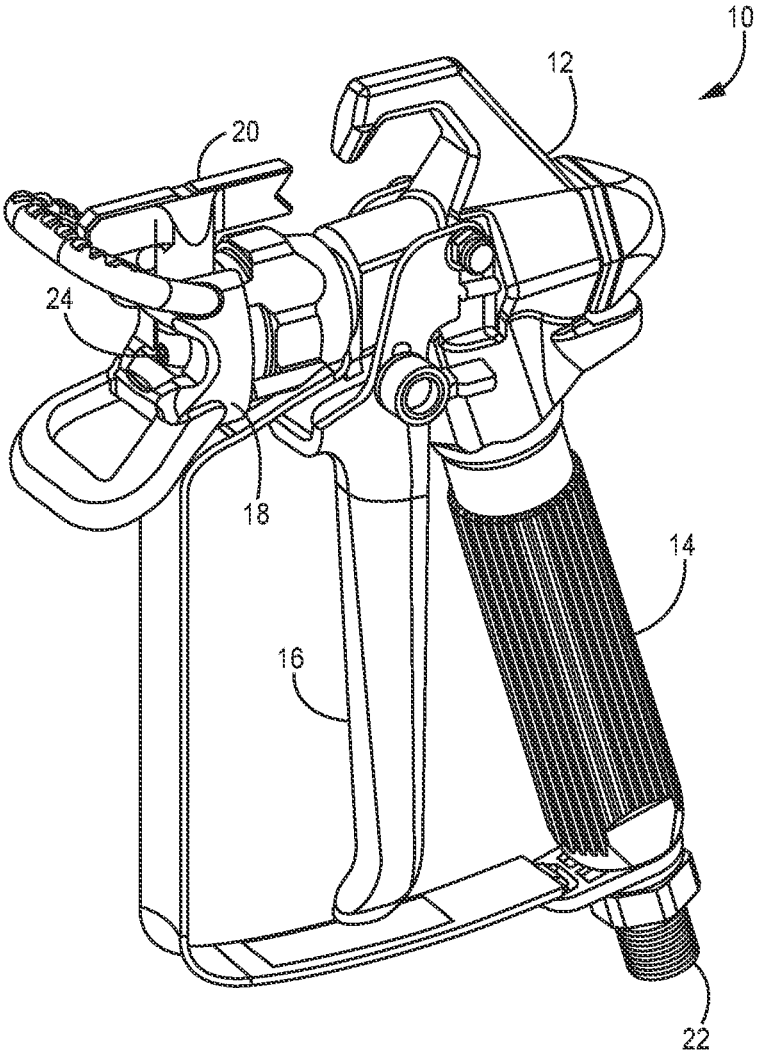
FIG. 1 is an isometric view of a spray gun including a spray tip.

FIG. 1 is an isometric view of spray gun 10, which can be operated to spray epoxies or other fluids (e.g., water, oil, stains, finishes, coatings, solvents, etc.). Spray gun 10 includes gun body 12, gun handle 14, trigger 16, nozzle holder 18, spray tip 20, and connector 22.

Gun body 12 is mounted on gun handle 14. Gun handle 14 can be formed from polymer or metal. Gun handle 14 is configured to be gripped by one hand of a user to hold, support, and aim spray gun 10 while also allowing the user to actuate trigger 16. Gun body 12 can be formed of any suitable material for receiving various components of spray gun 10 and for providing a pathway for pressurized paint. In some examples, gun body 12 is formed from a metal, such as aluminum. Gun body 12 and gun handle 14 can be formed separately and assembled together, either permanently or removably.

Spray gun 10 can be supported and operated by a single hand of the user during spraying. The user grasps gun handle 14 with a hand and can actuate trigger 16 with the fingers of that hand. A valve mechanism (not shown) is located in the spray gun 10 and operably interfaces with the trigger 16 to be actuated by trigger 16. Actuating trigger 16 causes epoxy to be sprayed out of outlet orifice 24 of spray tip 20.

Connector 22 is attached to bottom of gun handle 14 and is configured to attach to the end of a hose that supplies epoxy to spray gun 10 under pressure. Connector 22 can be of a quick disconnect type, or any other desired type of hose connector to connect to a fitting of a supply hose (not shown). In some examples, connector 22 is threaded to interface with threading on the fitting of the supply hose. Connector 22 receives a flow of epoxy under pressure from a pump via the supply hose. The pressure of the fluid output by the pump and received at the connector 22 for spraying can be between about 13.8-69.6 Megapascal (MPa) (about 2,000-10,000 pounds per square inch (psi)), with pressures of about 34.8-51.7 MPa (about 5,000-7,500 psi) being typical, although other pressures are possible. It should be understood that this is but one type of spray gun or sprayer within which the features of the present disclosure could be embodied. Spray gun 10 can be an airless spray gun in that compressed air is not provided to spray gun 10 to atomize the epoxy.

Nozzle holder 18 is supported by gun body 12. In some examples, nozzle holder 18 can be removably mounted to gun body 12. For example, nozzle holder 18 can fit over a front end of gun body 12 to connect to gun body 12. In some examples, nozzle holder 18 can include internal threading that interfaces with external threading on the front end of gun body 12 to fix nozzle holder 18 to gun body 12.

Spray tip 20 is mounted in a bore of nozzle holder 18. Spray tip 20 is easily removable from the nozzle holder 18 (and the rest of the spray gun 10) to exchange different spray tips 20 for a desired spray pattern or remove spray tips 20 for cleaning. Exchanging spray tips 20 can be advantageous, for example, to vary spray patterns, or for cleaning of dirty spray tips 20. Spray tip 20 includes a cylindrical body that is insertable into a bore of nozzle holder 18 to provide a desired spray pattern. Spray tip 20 is rotatable within nozzle holder 18 so that spray tip 20 can be reversed in direction (i.e., rotated roughly 180° to reverse the direction of flow through spray tip 20 to unclog spray tip 20). Spray tip 20 can rotate within nozzle holder 18 to the original position to resume spraying. Outlet orifice 24 is formed in spray tip 20. Outlet orifice 24 is formed to atomize the epoxy into a fluid spray pattern as the epoxy exits spray gun 10 with spray tip 20 in the normal spray position.

Figure 2:
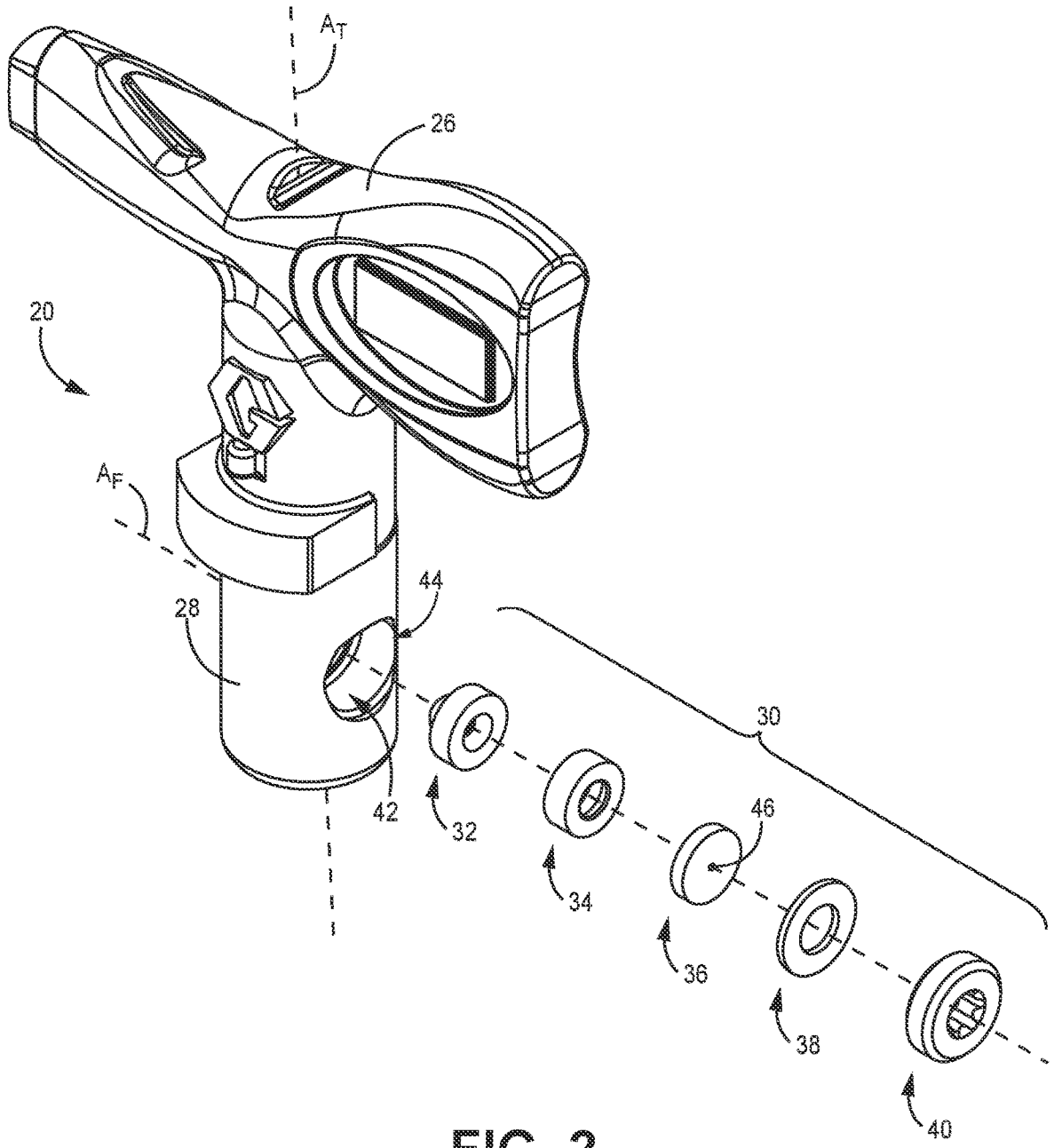
FIG. 2 is an isometric exploded view of a spray tip.

FIG. 2 is an isometric exploded view of spray tip 20, shown for simplicity isolated from spray gun 10. Spray tip 20 includes handle 26, tip body 28, tip piece 32, spacer 34, pre-orifice piece 36, washer 38, and retainer 40. Tip body 28 includes tip bore 42.

Handle 26 is useful for gripping spray tip 20 for removal and/or rotating spray tip 20, as discussed above. Handle 26 can be formed from a polymer material, or other suitable material. Tip body 28 extends downward from handle 26. Tip body 28 can be formed from metallic material, such as steel, although other materials are contemplated herein. Tip body 28 can be cylindrical. Tip body 28 is elongated along body axis $A_T$ which is coaxial with tip body 28 (the flow of paint generally being perpendicular to the body axis $A_T$). The exterior contouring of the cylindrical tip body 28 facilitates rotation of the spray tip 20 to reverse the flow of fluid through the spray tip 20 for unclogging. While the spray tip 20 of this embodiment includes a cylindrical tip body 28, not all embodiments are so limited. Another version can include a non-cylindrical tip body 28, which can be metallic, having an aperture therethrough, same or similar to tip bore 42, with the same or similar tip parts 30 within the aperture.

Tip body 28 includes tip bore 42 that extends through tip body 28. Tip bore 42 extends entirely through the tip body 28. FIG. 2 shows an upstream opening 44 of tip bore 42. Tip bore 42 extends along flow axis $A_F$ that is transverse to body axis $A_T$. Flow axis $A_F$ extends through and can intersect with body axis $A_T$. Flow axis $A_F$ can be orthogonal to body axis $A_T$.

Various of tip parts 30 are located in tip bore 42 for handling the flow of fluid through the spray tip 20. Tip parts 30, in this embodiment, includes a tip piece 32, spacer 34, pre-orifice piece 36, washer 38, and retainer 40. Tip parts 30 are generally symmetric about flow axis $A_F$. Each of tip parts 30 and tip bore 42 are coaxial on flow axis $A_F$, in the example shown. It is understood, however, that tip parts 30 can be aligned on a spray axis and tip bore 42 can be aligned on a bore axis offset from the spray axis. It is understood that, in some examples, tip parts 30 do not include spacer. In some examples, various ones of tip parts 30 can be formed together as single pieces. For example, retainer 40 and pre-orifice piece 36 can be formed as a single part.

Retainer 40 is ring-shaped with the central hole to allow fluid flow through the retainer 40. The retainer 40 can be threaded, press fit, adhered, or otherwise anchored in the tip bore 42. Washer 38 provides spacing between retainer 40 and pre-orifice piece 36. Pre-orifice piece 36 includes an inlet orifice 46. Inlet orifice 46 forms a narrowest part of the fluid passage through pre-orifice piece 36. As such, inlet orifice 46 forms a smallest flow area portion of the fluid passage through pre-orifice piece 36. Spacer 34 defines part of a turbulation chamber (discussed in more detail below). Tip piece 32 defines a narrowing flow path through the tip piece 32. Outlet orifice 24 (best seen in FIGS. 3B-8) is formed in tip piece 32. Outlet orifice 24 defines a narrowest part of the fluid passage through tip piece 32. As such, outlet orifice 24 defines a smallest flow area portion of the fluid passage through tip piece 32.

Tip parts 30 are retained within tip bore 42 during operation. During normal spraying, the fluid enters tip bore 42 and flows in a downstream direction through retainer 40 and washer 38 to pre-orifice piece 36. Inlet orifice 46 forms a restriction in the flowpath through spray tip 20. The fluid flows through inlet orifice 46 and to the turbulation chamber 90. The fluid flows through the turbulation chamber 90 and exits spray tip 20 through outlet orifice 24 as an atomized spray.

Figure 3A:
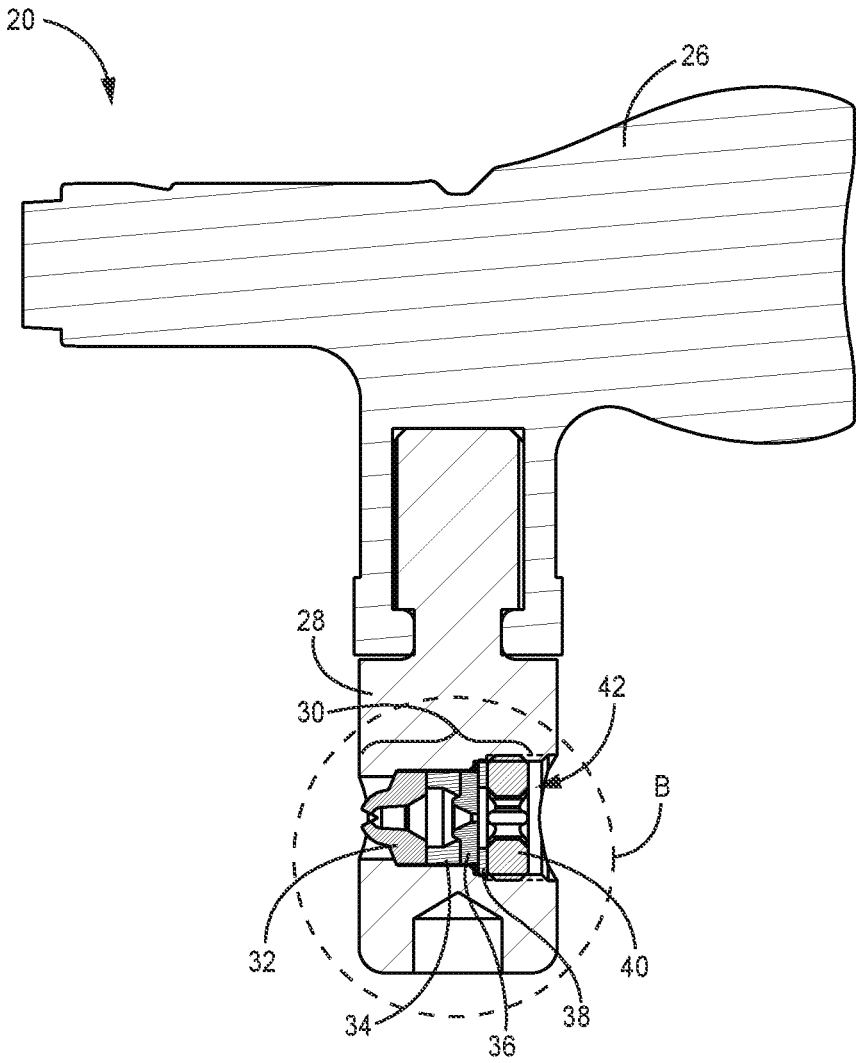
FIG. 3A is a cross-sectional view of the spray tip.
Figure 3B:
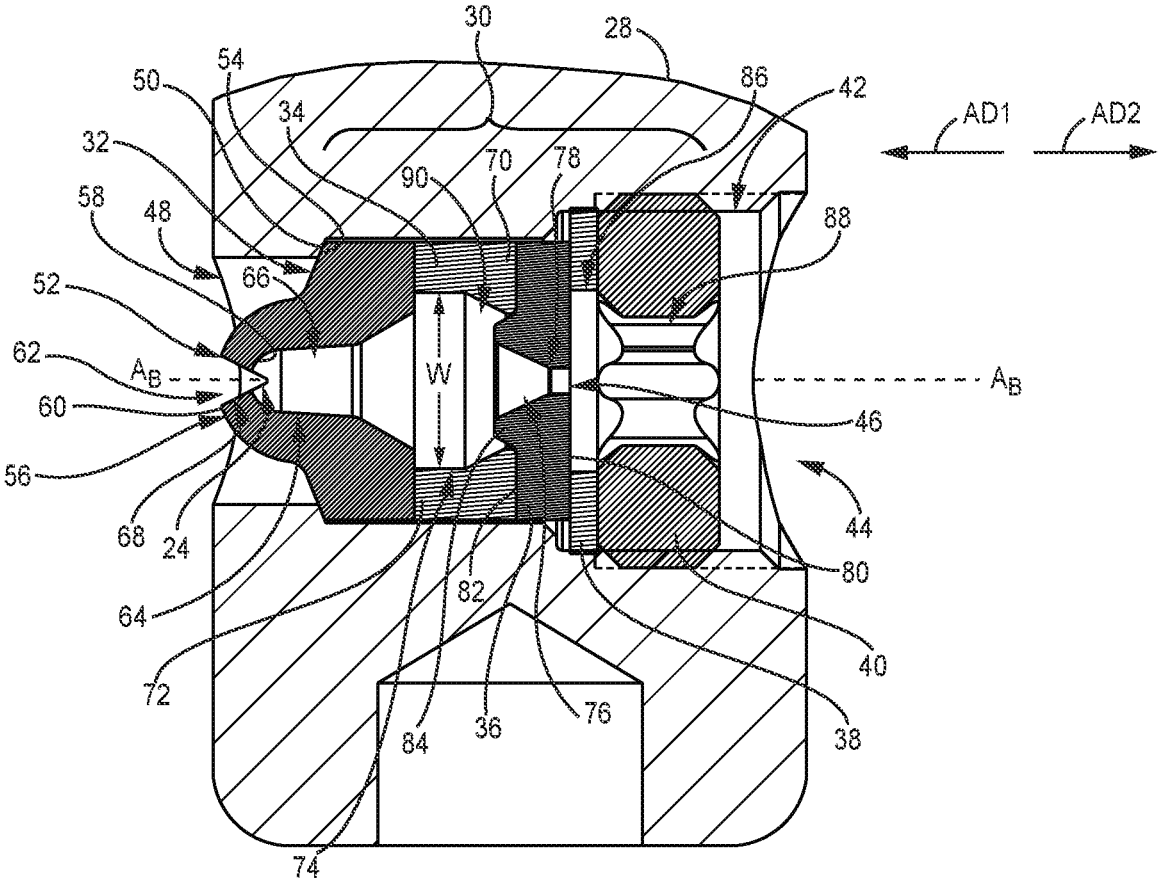
FIG. 3B is an enlarged view of detail B in FIG. 3A.

FIG. 3A is a cross-sectional view of spray tip 20. FIG. 3B is an enlarged view of detail B in FIG. 3A. FIGS. 3A and 3B will be discussed together. Spray tip 20 includes handle 26, cylindrical body 28, tip piece 32, spacer 34, pre-orifice piece 36, washer 38, and retainer 40. Cylindrical body 28 includes tip bore 42. Tip bore 42 includes upstream opening 44, downstream opening 48, and stop 50. Tip piece 32 includes outlet orifice 24, downstream opening 52, shoulder 54, spray end 56, inner dome 58, outer dome 60, cut 62, tip channel 64, outlet channel 66, and spray channel 68. Spacer 34 includes first end 70, second end 72, and spacer channel 74. Pre-orifice piece 36 includes inlet orifice 46, expansion portion 76, pre-orifice channel 78, first end 80, second end 82, and extension 84. Washer 38 includes washer channel 86. Retainer 40 includes retainer channel 88.

Tip piece 32, spacer 34, pre-orifice piece 36, washer 38, and retainer 40 together form tip parts 30 of spray tip 20. It is understood, however, that tip parts 30 can include more or fewer components than those shown. In addition, one or more of the components shown as forming tip parts 30 can be formed together as unitary parts. Tip bore 42 extends fully through cylindrical body 28 between upstream opening 44 and downstream opening 48.

Tip parts 30 are disposed within tip bore 42. Tip parts 30 are generally aligned (e.g., coaxial) relative each other. In the example shown, tip parts 30 are coaxial about flow axis $A_F$. The first axial direction AD1 and second axial direction AD2 are indicated. During normal spray operations the first axial direction AD1 is the downstream direction and the second axial direction AD2 is the upstream direction. During normal use of spray tip 20, fluid flows in first axial direction AD1 through tip parts 30 (and through the tip bore 42). Fluid flows in the reverse direction (in second axial direction AD2) only when spray tip 20 is rotated to reverse the direction of flow for unclogging, which can be a relatively rare procedure compared to spray operations. It is understood that the terms "upstream" and "downstream" are generally utilized herein as referred to the directly of fluid flow during normal operations. However, the flow is reversed during unclogging, as discussed above.

Going in second axial direction AD2 from downstream opening 48 towards upstream opening 44, tip parts 30 in the example shown include tip piece 32, spacer 34, pre-orifice piece 36, washer 38, and retainer 40. During assembly, tip parts 30 are inserted into tip bore 42 through upstream opening 44. Tip piece 32 can be inserted first such that shoulder 54 engages stop 50. Spacer 34 abuts the upstream end of tip piece 32. Pre-orifice piece 36 is disposed such that second end 82 abuts the first end 70 of spacer 34. Washer 38 is inserted and abuts first end 80 of pre-orifice piece 36. Retainer 40 is inserted and secures the other tip parts 30 within tip bore 42. For example, retainer 40 can engage tip body 28 within tip bore 42, such as by interfaced threading, to secure the other tip parts 30 within tip bore 42.

Retainer 40 is ring-shaped with retainer channel 88 extending therethrough. Retainer channel 88 allows fluid flow through retainer 40. Retainer 40 can include contouring on the portion of retainer 40 defining retainer channel 88. The contouring can be configured to engage a tool, such as a wrench, driver, etc. for facilitating installation and removal of retainer 40. Retainer 40 can be threaded, press fit, adhered, or otherwise anchored in tip bore 42. In some examples, a diffuser bar is mounted to retainer 40 and extends into or across retainer channel 88 to axially overlap with inlet orifice 46. The diffuser bar breaks up the flow stream exiting inlet orifice 46 when the position of spray tip 20 is reversed to the de-clog position.

Washer 38 is disposed axially between retainer 40 and pre-orifice piece 36. Washer 38 provides spacing between retainer 40 and the pre-orifice piece 36. Inlet orifice 46 is formed in pre-orifice piece 36. Pre-orifice channel 78 extends through pre-orifice piece 36 between first end 80 and second end 82. In the example shown, inlet orifice 46 is a circular hole in the pre-orifice piece 36 and defines at least a portion of pre-orifice channel 78. Inlet orifice 46 is coaxial with axis $A_F$. Inlet orifice 46 is the narrowest fluid passage of the pre-orifice piece 36 and thus defines the smallest flow area though pre-orifice piece 36. In some examples, inlet orifice 46 is formed at first end 80 of pre-orifice piece 36. Inlet orifice 46 can define the portion of pre-orifice channel 78 furthest in second axial direction AD2. Inlet orifice 46 can define the upstream-most portion of pre-orifice channel 78. For example, inlet orifice 46 can define the inlet of pre-orifice channel 78. It is understood, however, that inlet orifice 46 can be formed at other axial locations along pre-orifice channel 78. Inlet orifice 46 forms the narrowest portion of the fluid passage through tip parts 30 and thus defines the smallest flow area portion through tip parts 30. Inlet orifice 46 forms the narrowest portion of the fluid passage through tip bore 42.

As shown, the pre-orifice piece 36 includes expansion portion 76 extending in first axial direction AD1 relative to inlet orifice 46. Expansion portion 76 forms a part of pre-orifice channel 78 extending in first axial direction AD1 from inlet orifice 46. In the example shown, expansion portion 76 is frustoconical in shape, however other shapes of expansion portion 76 are possible. For example, expansion portion can include step expansions, amongst other options.

Pre-orifice channel 78 forms a restriction in the flow path through the tip parts 30, and thus through spray tip 20. The restriction is relative a relatively expanded portion of the flow path in second axial direction AD2 relative inlet orifice 46 (e.g., upstream of inlet orifice 46 during normal spray operations) and a relatively expanded portion of the flow path in first axial direction AD1 relative inlet orifice 46 (e.g., downstream of inlet orifice 46 during normal spray operations).

Spacer 34 is disposed axially between pre-orifice piece 36 and tip piece 32. In the example shown, extension 84 of pre-orifice piece 36 extends into spacer 34. Extension 84 extends in first axial direction AD1 relative to first end 70 of spacer 34. Second end 72 abuts tip piece 32. It is understood, however, that spacer 34 can be integral with, and part of, at least one of pre-orifice piece 36 and the tip piece 32.

Spacer 34 defines part of turbulation chamber 90. Turbulation chamber 90 is disposed downstream of inlet orifice 46 and allows for expansion of the fluid path downstream of inlet orifice 46 during normal spray operations. The fluid expansion causes fluid shear that assists in atomizing the fluid as the fluid exits through outlet orifice 24. Turbulation chamber 90 includes a maximum width W. In some examples, the turbulation chamber 90 is symmetrical about flow axis $A_F$ such that the maximum width W is a largest diameter of turbulation chamber 90. It is understood that the maximum width W of turbulation chamber 90 can be formed at any axial location within turbulation chamber 90 suitable for causing the desired fluid shear. The maximum width W is larger than both a major length L1 (FIGS. 7 and 8) of outlet orifice 24 and a minor length L2 (FIGS. 7 and 8) of outlet orifice 24. The maximum width W is larger than any dimension of outlet orifice 24 taken radially away from axis $A_F$. The maximum width W is larger than any dimension of inlet orifice 24 taken radially away from axis $A_F$ (e.g., maximum width W is larger than the diameter of a circular inlet orifice 24). Turbulation chamber 90 is thus wider than outlet orifice 24 and wider than inlet orifice 46.

Tip bore 42 narrows in steps in the first axial direction AD1. The narrowest part of the tip bore 42 seats and holds tip piece 32. Stop 50 forms a step to the narrowest portion of tip bore 42. The narrowest portion of tip bore 42 has a smaller diameter than tip piece 32. Stop 50 engages at least a portion of shoulder 54 to define the extent to which tip parts 30 can extend in the first axial direction AD1 within tip bore 42. Therefore, in the example shown, tip parts 30 are sandwiched between tip piece 32 in the first axial direction AD1 and retainer 40 in the second axial direction AD2

Tip piece 32 defines tip channel 64 that forms a fluid flowpath through tip piece 32. Tip channel 64 includes outlet channel 66 that extends in the first axial direction AD1 through the tip piece 32 to outlet orifice 24. Tip channel 64 includes spray channel 68 that extends in the first axial direction AD1 through tip piece 32 from outlet orifice 24.

Outlet channel 66 is a narrowing of the flowpath through tip parts 30. In the example shown, outlet channel 66 narrows in portions extending axially in the first axial direction AD1 from the upstream end of tip piece 32. Axial portions of tip piece 32 defining outlet channel 66 are frustoconical in shape, in the example shown. It is understood, however, that other shapes and configurations are possible, such as steps and/or rounded convergences, amongst other options.

Tip piece 32 includes contoured spray end 56. Spray end 56 extends in first axial direction AD1 within tip bore 42 relative to the interface between shoulder 54 and stop 50. In some examples, the distal end of spray end 56 can project in the first axial direction AD1 relative to a portion of the tip body 28 defining a portion of downstream opening 48 of tip bore 42. Spray end 56 includes a curved outer surface forming outer dome 60 and a curved inner surface forming inner dome 58. Inner dome 58 defines at least a portion of outlet channel 66. Outlet orifice 24 is formed in inner dome 58. Outlet orifice 24 defines the narrowest part of tip channel 64 through tip piece 32. Outlet orifice 24 is configured to atomize the fluid flowing through the tip piece 32 into a spray pattern, such as a spray fan, as the fluid exits spray tip 20. The spray fan is shaped by the edge of outlet orifice 24.

In the example shown, outlet orifice 24 is defined by cut 62 into inner dome 58 of tip piece 32. Cut 62 extends into tip piece 32 and forms outlet orifice 24. Spray channel 68 extends downstream from outlet orifice 24 to a downstream opening 52 and is formed by cut 62. Outlet orifice 24 can be considered to define the upstream-most portion of the spray channel 68 extending between inner dome 58 and outer dome 60.

Inlet orifice 46 is the narrowest part of pre-orifice channel 78. Likewise, outlet orifice 24 is the narrowest part of tip channel 64. Inlet orifice 46 thereby defines the smallest flow area portion of the flowpath through pre-orifice piece 36 and outlet orifice 24 likewise defines the smallest flow area portion of the flowpath through tip piece 32. Inlet orifice 46 and outlet orifice 24 define the two narrowest portions of the fluid flowpath between upstream opening 44 and downstream opening 48. Inlet orifice 46 and outlet orifice 24 form the two narrowest portions of the fluid flow path through tip bore 42 and thus define the two smallest flow area portions through tip bore 42. Inlet orifice 46 and outlet orifice 24 form the two narrowest portions of the flowpath through tip parts 30 of spray tip 20.

Turbulation chamber 90 is formed between inlet orifice 46 and outlet orifice 24. Epoxy flowing through tip parts 30 in tip bore 42 undergoes a dramatic restriction at inlet orifice 46 such that the fluid jets through inlet orifice 46 into turbulation chamber 90. The dramatic fluid path expansion along the turbulation chamber 90 facilitates shearing of the fluid, which can temporarily lower the viscosity of the fluid to facilitate atomization upon release from outlet orifice 24. The lower viscosity facilitates the desired atomization at lower pressures, facilitating generating the desired spray pattern and coverage at the lower pressures.

Inlet orifice 46 is smaller than outlet orifice 24. As further explained herein, the functional-flow cross-sectional area of inlet orifice 46 is smaller than the functional-flow cross-sectional area of outlet orifice 24. The difference in areas creates a greater bottleneck for the fluid flow in second axial direction AD2 relative to turbulation chamber 90 (upstream during normal operation), at inlet orifice 46 than at outlet orifice 24. As such, the greatest restriction in the flowpath through tip parts 30 is at inlet orifice 46 at a location upstream of both turbulation chamber 90 and the atomizing outlet orifice 24. The functional-flow cross-sectional area can be the cross-sectional area (not necessarily two dimensional or otherwise flat cross section) of the orifice lip that either abruptly constricts flow (e.g., in the case of inlet orifice 46) and/or abruptly releases a fluid spray (e.g., in the case of outlet orifice 24).

Outlet orifice 24 has an equivalent orifice diameter, which is defined as the diameter of a circular orifice where the resistance to flow is equivalent to that of the irregularly (i.e., non-circular) orifice in question, greater than the equivalent orifice diameter of inlet orifice 46. As such, a circular orifice having the same flow resistance as outlet orifice 24 will have a diameter larger than a circular orifice having the same flow resistance as inlet orifice 46. Outlet orifice 24 offers less resistance to flow than inlet orifice 46. The pressure drop is greater across inlet orifice 46 than across outlet orifice 24. Given the same upstream pressure, the flow through outlet orifice 24 is greater than the flow through inlet orifice 46.

Outlet orifice 24 being larger than inlet orifice 46 provides significant advantages. Outlet orifice 24 being larger than inlet orifice 46 facilitates the use of lower pressures to generate desired spray patterns. Spray tip 20 can atomize thick, viscous fluids at relatively lower pressures. In some examples, the pressure required to generate the desired spray pattern can be up to about 6.89 MPa (about 1,000 psi) less than other spray tips. In some examples, the pressure required to generate the desired spray pattern can be up to about 20% less than other spray tips. The lower pressures allow for better coating thickness control and facilitate closer spray distances that provide easier control and reduce waste. Less solvent is required, providing a material savings. In addition, epoxies can be sprayed at lower temperatures, saving on heating requirements and costs.

The relative configurations of inlet orifice 46 and outlet orifice 24 further facilitates blendable spray patterns. Blending occurs at the edges of spray swaths where adjacent swaths overlap. A tapered distribution across the spray fan from the middle towards the edges is preferred to facilitate an aesthetically pleasing, even finish. The relative configurations provide patterns having an evenly tapered material distribution towards the edges of the spray fan. The user can utilize spray tips 20 having different ratios between the sizes of the inlet orifice 46 and the outlet orifice 24 to vary the fluid distribution across the width of the spray fan. Spray tip 20 generates a spray pattern that maintains desired coating thickness with less material consumption. Spray tip 20 thereby provides cost and material savings and facilitates an efficient spray process.

Figure 4A:
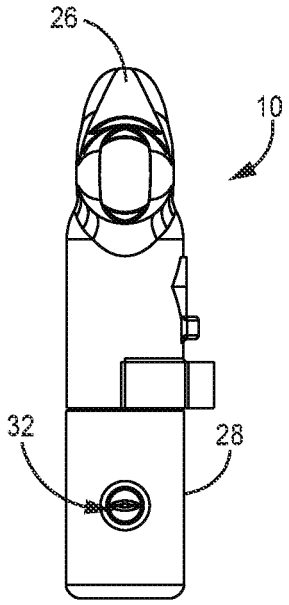
FIG. 4A is a front elevational view of a spray tip.
Figure 4B:
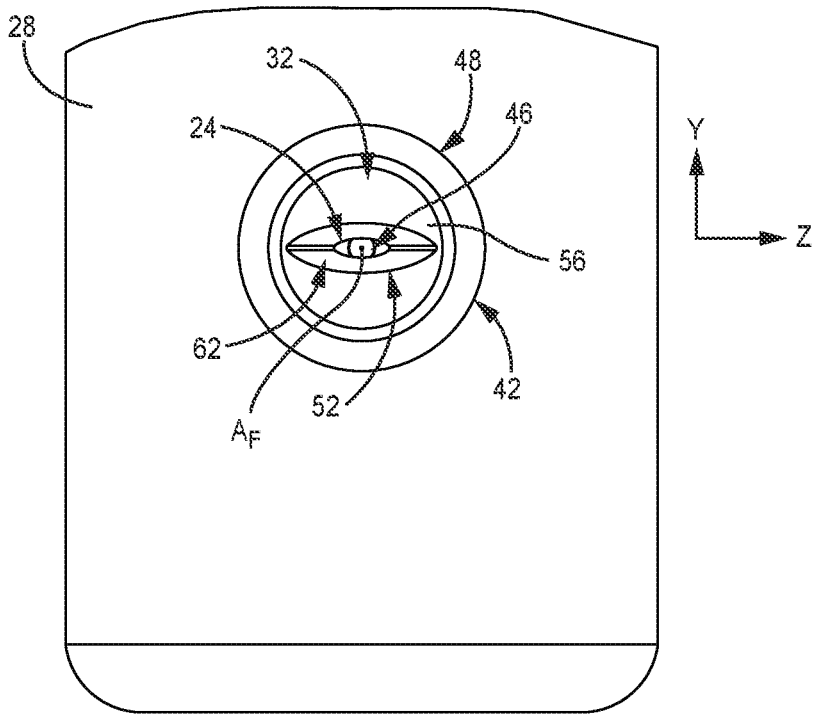
FIG. 4B is an enlarged view of detail B in FIG. 4A.
Figure 4C:
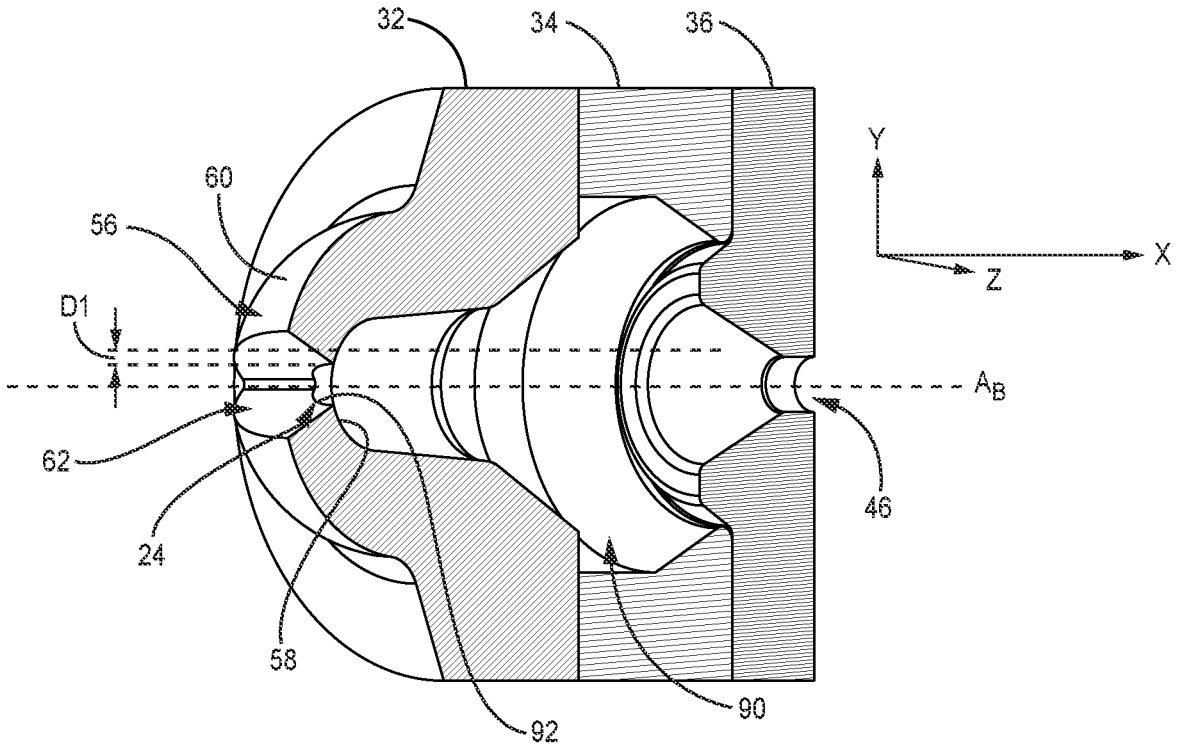
FIG. 4C is an isometric cross-sectional view of a tip assembly.

FIG. 4A is a front elevational view of spray tip 20. FIG. 4B is an enlarged view of detail B in FIG. 4A. FIG. 4C is an isometric cross-sectional view of tip piece 32, spacer 34, and pre-orifice piece 36 assembled together. FIGS. 4A-4C will be discussed together. Tip handle 26, cylindrical body 28, downstream opening 48 of tip bore 42, and tip piece 32 are shown. Cut 62 out of tip piece 32 and through outer dome 60 is shown. Outlet orifice 24, inlet orifice 46, and downstream opening 52 are shown.

Outlet orifice 24 has a major dimension and a minor dimension smaller than the major dimension. In the example shown, outlet orifice 24 has a cat eye shape. The cat eye shape can be formed by the angled cut 62 made through tip piece 32 and into inner dome 58. The angled cut 62 can be a V-shaped cut. Cut 62 can have curved edges between its longitudinal ends due to the domed shape of outlet end 56. Outlet orifice 24 has a major (longer) dimension or axis in direction Z and a minor (shorter) dimension or axis in direction Y. It is understood that the ratio between the major dimension and the minor dimension can be varied to adjust the spray pattern and fluid distribution across the pattern.

As shown in FIG. 4B, inlet orifice 46 is overlapped at least partially by outlet orifice 24. As such, a portion of inlet orifice 46 is obscured by tip piece 32 when viewed in the upstream direction along axis $A_F$. A largest dimension of inlet orifice 46 is larger than the minor dimension of outlet orifice 24. For example, the diameter of a circular inlet orifice 46 can be larger than a minor length of outlet orifice 24 between the long, curved edges of outlet orifice 24. It is understood that the ratio between the dimension of the inlet orifice 46 and the minor dimension can be varied to adjust the spray pattern and fluid distribution across the pattern. Inlet orifice 46 has a smaller cross-sectional area than outlet orifice 24 and includes a dimension larger than a corresponding dimension of outlet orifice 24.

As shown in FIG. 4C, inlet orifice 46 can be circular and a cross-sectional area of inlet orifice 46 can be represented by a flat circle (e.g., only two dimensional) orthogonal to the axis $A_F$. However, outlet orifice 24 is curved through three dimensions such that a section taken along the outlet orifice 24 is defined by a three-dimensional cross-section that is not flat. The lip 92 defining outlet orifice 24 curves through planes X-Y, Z-Y, and Z-X.

An overlap D1 is present between a projection of inlet orifice 46 and inner dome 58. At least a portion of inlet orifice 46 radially overlaps with inner dome 58 while another portion radially overlaps with outlet orifice 24. Inner dome 58 obstructs the flowpath of a portion of the fluid exiting inlet orifice 46. The obstruction deflects the fluid and generates turbulence in the flow, facilitating desired flow characteristics, such as shear and pressure, through turbulation chamber 90.

The configuration of inlet orifice 46 and outlet orifice 24 provides significant advantages. A projection of inlet orifice 46 radially overlaps with inner dome 58 to facilitate turbulence in the flow. The larger dimensional sectional area of outlet orifice 24 relative to inlet orifice 46 facilitates spraying thick, viscous fluids at relatively lower pressures. The relative configurations of outlet orifice 24 and inlet orifice 46 also facilitates desired fluid distribution across the width of the spray fan. As such, the operator can apply a more even pattern having a consistent overlap, providing more efficient spray operations and material cost savings.

Figure 5:
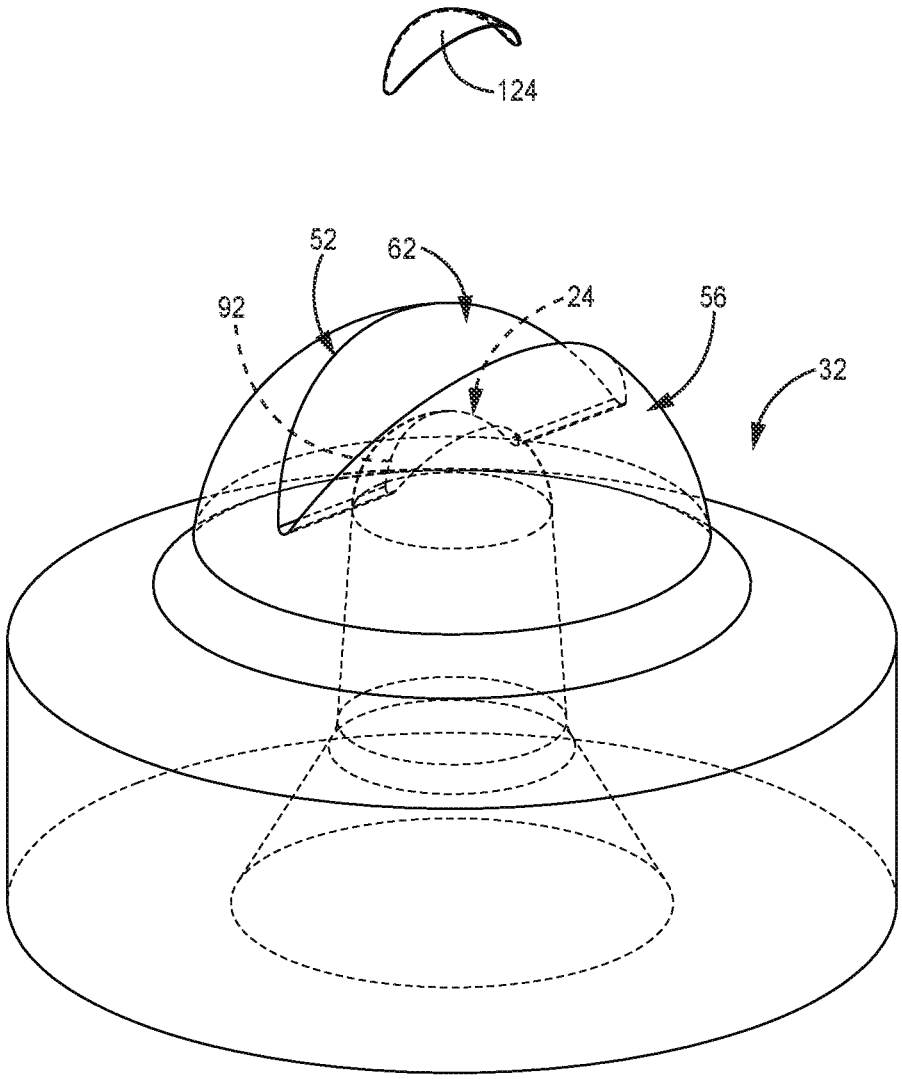
FIG. 5 is an isometric view of a tip piece showing a projection of the outlet orifice.

FIG. 5 is an isometric view of tip piece 32 showing projection 124 of outlet orifice 24. Projection 124 shows the functional flow cross-sectional area of outlet orifice 24. Lip 92 that defines outlet orifice 24 is curved, and not flat, relative to the axis $A_F$ on which tip piece 32 is aligned during operation. Lip 92 can curve in three dimensions. As such, the two-dimensional cross-sectional area of outlet orifice 24 (shown below in FIG. 6 and FIG. 7) differs from the actual, three-dimensional functional flow cross-sectional area of outlet orifice 24. In that way, outlet orifice 24 further differs from inlet orifice 46 in that the two-dimensional and three-dimensional cross-sectional areas of inlet orifice 46 can be the same while the two-dimensional and three-dimensional cross-sectional areas of outlet orifice 24 differ.

Figure 6:
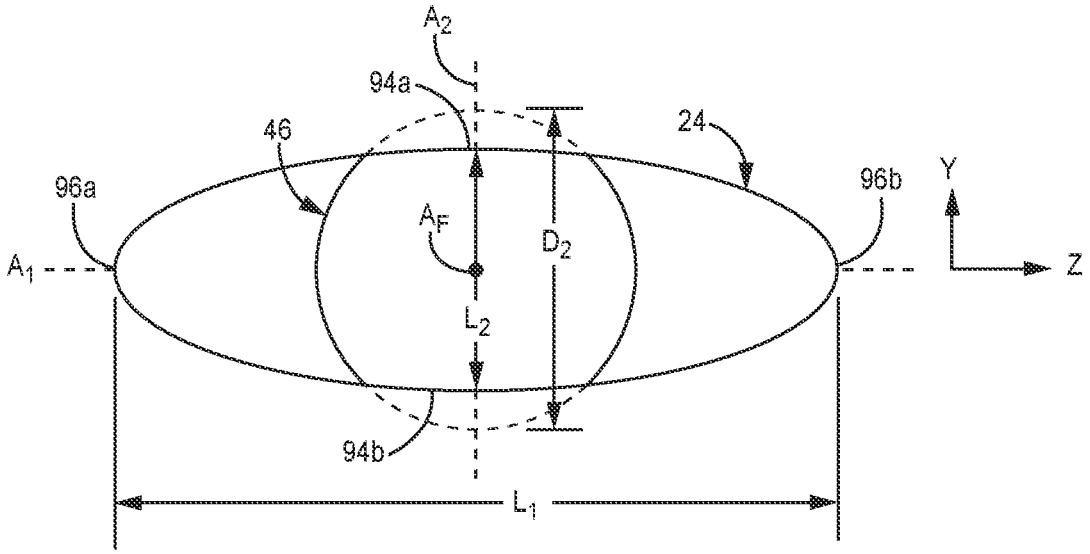
FIG. 6 is an elevational end view of an outlet orifice overlaid on an inlet orifice.

FIG. 6 is an elevational end view showing a projection of outlet orifice 24 overlaid on a projection of inlet orifice 46. The projections of inlet orifice 46 and outlet orifice 24 in FIG. 6 are two-dimensional projections.

Outlet orifice 24 includes outlet sides 94*a*, 94*b* and outlet ends 96*a*, 96*b*. outlet sides 94*a*, 94*b* can be considered lateral ends and outlet ends 96*a*, 96*b* can be considered lateral ends. Outlet orifice 24 has major axis A1 and minor axis A2. Outlet sides 94*a*, 94*b* are curved between outlet ends 96*a*, 96*b*. In some examples, one or both of outlet sides 94*a*, 94*b* have a uniform radius of curvature between outlet ends 96*a*, 96*b* and taken relative to axis $A_F$. In some examples, one or both of outlet sides 94*a*, 94*b* has a non-uniform radius of curvature. For example, one or both of outlet sides 94*a*, 94*b* can have one of a larger or smaller radius of curvature proximate minor axis A2 than proximate outlet ends 96*a*, 96*b*.

Outlet orifice 24 has a major dimension (its longest diameter, along the elongate axis A1) taken along line Z and a minor dimension (its shortest diameter, orthogonal to the elongate axis A1) taken along line Y. Length L1 is taken along major axis A1 and length L2 is taken along minor axis A2. In the example shown, inlet orifice 46 is circular. Inlet orifice 46 includes diameter D2.

Diameter D2 of inlet orifice 46 is larger than length L2 of outlet orifice 24. The larger diameter D2 of inlet orifice 46 relative to the length L2 of outlet orifice 24 facilitates generating the desired fluid shear. Diameter D2 is smaller than length L1.

The two-dimensional projection of outlet orifice 24 has a larger cross-sectional area than the two-dimensional projection of inlet orifice 46. The cross-sectional area of inlet orifice 46 is less than the cross-sectional area of outlet orifice 24. In some examples, the cross-sectional area of inlet orifice 46 is about ⅓ smaller than the cross-sectional area of outlet orifice 24. In some examples, the cross-sectional area of inlet orifice 46 is at least ⅓ smaller than the cross-sectional area of outlet orifice 24. The relative sizes and orientations of inlet orifice 46 and outlet orifice 24 chokes the flow at outlet orifice 24.

The functional-flow cross-sectional area of inlet orifice 46 is also less than the functional-flow cross-sectional area of outlet orifice 24. As discussed above, the functional-flow cross-sectional area of outlet orifice 24 is shown in FIG. 5 and is formed in three dimensions. The functional-flow cross-sectional area of inlet orifice 46 is formed in two dimensions. In some embodiments, the functional-flow cross-sectional area of inlet orifice 46 is about ⅓ smaller than the functional-flow cross-sectional area of outlet orifice 24. In some embodiments, the functional-flow cross-sectional area of inlet orifice 46 is at least ⅓ smaller than the functional-flow cross-sectional area of outlet orifice 24.

While outlet orifice 24 is non-circular and inlet orifice 46 is circular in the example shown, it is understood that outlet orifice 24 has an equivalent orifice diameter larger than the equivalent orifice diameter of inlet orifice 46. As such, outlet orifice 24 allows greater flow than inlet orifice 46. A circular orifice in two dimensions having the same flow resistance as outlet orifice 24 will have a larger diameter than diameter D2 of inlet orifice 46. In some embodiments, the equivalent orifice diameter of inlet orifice 46 is about ⅓ smaller than the equivalent orifice diameter of outlet orifice 24. In some embodiments, the equivalent orifice diameter of inlet orifice 46 is at least ⅓ smaller than the equivalent orifice diameter of outlet orifice 24.

Figure 7:
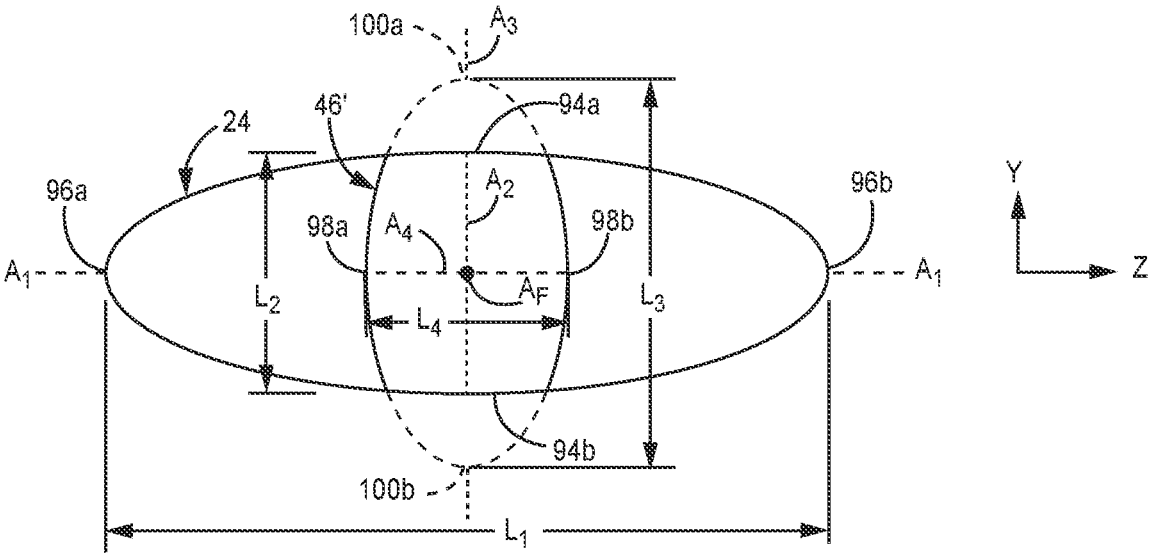
FIG. 7 is an elevational end view of an outlet orifice overlaid on an inlet orifice.

FIG. 7 is an elevational end view showing a projection of outlet orifice 24 overlaid on a projection of inlet orifice 46'. The projections of inlet orifice 46' and outlet orifice 24 in FIG. 7 are two-dimensional projections.

Outlet orifice 24 includes outlet sides 94*a*, 94*b* and outlet ends 96*a*, 96*b*. Outlet orifice 24 has major axis A1 and minor axis A2. Outlet sides 94*a*, 94*b* are curved between outlet ends 96*a*, 96*b*. In some examples, one or both of outlet sides 94*a*, 94*b* have a uniform radius of curvature between outlet ends 96*a*, 96*b* and taken relative to axis $A_B$. In some examples, one or both of outlet sides 94*a*, 94*b* has a non-uniform radius of curvature. For example, one or both of outlet sides 94*a*, 94*b* can have one of a larger or smaller radius of curvature proximate minor axis A2 than proximate outlet ends 96*a*, 96*b*.

Outlet orifice 24 has a major dimension (its longest diameter, along the elongate axis A1) taken along direction Z and a minor dimension (its shortest diameter, along the axis A2) taken along direction Y. Length L1 is taken along major axis A1 and length L2 is taken along minor axis A2. Axis A1 is transverse to axis A2. In some examples, axis A1 is orthogonal to axis A2. Axis A1 can be substantially perpendicular to axis A2.

Inlet orifice 46' includes inlet sides 98*a*, 98*b* and inlet ends 100*a*, 100*b*. Inlet orifice 46' has major axis A3 and minor axis A4. Inlet sides 98*a*, 98*b* are curved between inlet ends 100*a*, 100*b*. In some examples, one or both of inlet sides 98*a*, 98*b* has a uniform radius of curvature between inlet ends 100*a*, 100*b* and taken relative to axis $A_F$. In some examples, one or both of inlet sides 98*a*, 98*b* has a non-uniform radius of curvature. For example, one or both of inlet sides 98*a*, 98*b* can have one of a larger or smaller radius of curvature proximate minor axis A4 than proximate inlet ends 100*a*, 100*b*.

Inlet orifice 46' has a major dimension (its longest diameter, along the elongate axis A3) taken along direction Y and a minor dimension (its shortest diameter, along the axis A4)

taken along direction Z. Length L3 is taken along major axis A3 and length L4 is taken along minor axis A4. Axis A3 is transverse to axis A4. In some examples, axis A3 is orthogonal to axis A4. Axis A3 can be substantially perpendicular to axis A4.

Axis A1 can be coaxial with axis A4. Axis A1 can be parallel to axis A4. Axis A2 can be coaxial with axis A3. Axis A2 can be parallel to axis A3. It is understood that, in some examples, inlet orifice 46 and outlet orifice 24 can be disposed non-orthogonal relative each other. For example, inlet orifice 46 can be rotated about axis $A_F$ such that axis A3 is angularly offset from axis A2. Length L3 of inlet orifice 46' is larger than length L2 of outlet orifice 24. The larger length L3 of inlet orifice 46' relative to the length L2 of outlet orifice 24 facilitates the desired fluid shear in turbulation chamber 90. The larger length L3 relative to length L2 creates overlap that facilitates at least a portion of the fluid jet exiting inlet orifice 46' impacting inner dome 58 around outlet orifice 24. Lengths L3 and L4 are both shorter than length L1.

The two dimensional projection of outlet orifice 24 has a larger cross-sectional area than the two dimensional projection of inlet orifice 46'. The cross-sectional area of inlet orifice 46' is less than the cross-sectional area of outlet orifice 24. In some examples, the cross-sectional area of inlet orifice 46' is about ⅓ smaller than the cross-sectional area of outlet orifice 24. In some examples, the cross-sectional area of inlet orifice 46' is at least ⅓ smaller than the cross-sectional area of outlet orifice 24. The relative sizes and orientations of inlet orifice 46 and outlet orifice 24 chokes the flow at outlet orifice 24 to facilitate turbulence and shearing.

The functional flow cross sectional area of inlet orifice 46' is also less than the functional flow cross sectional area of outlet orifice 24. In some embodiments, the functional flow cross sectional area of inlet orifice 46' is about ⅓ smaller than the functional flow cross sectional area of outlet orifice 24. In some embodiments, the functional flow cross sectional area of inlet orifice 46' is at least ⅓ smaller than the functional flow cross sectional area of outlet orifice 24.

Each of outlet orifice 24 and inlet orifice 46' is non-circular. Outlet orifice 24 has an equivalent orifice diameter larger than the equivalent orifice diameter of inlet orifice 46'. As such, outlet orifice 24 allows greater flow than inlet orifice 46'. In some embodiments, the equivalent orifice diameter of inlet orifice 46' is about ⅓ smaller than the equivalent orifice diameter of outlet orifice 24. In some embodiments, the equivalent orifice diameter of inlet orifice 46' is at least ⅓ smaller than the equivalent orifice diameter of outlet orifice 24.

Figure 8:
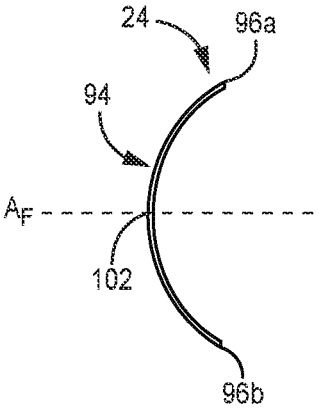
FIG. 8 is a top-down cross-sectional projection of an outlet orifice.

FIG. 8 is a top-down cross-sectional projection of outlet orifice 24. Outlet orifice 24 is curved in the downstream direction. Outlet side 94 is curved between outlet ends 96*a*, 96*b*. Centerpoint 102 of lateral side 94 is spaced axially along axis $A_F$ relative to the axial location of outlet ends 96*a*, 96*b*. In some examples, lateral side 94 has a uniform radius of curvature between outlet ends 96*a*, 96*b*. In some examples, lateral side 94 has a non-uniform radius of curvature. For example, lateral side 94 can have one of a larger or smaller radius of curvature proximate minor axis its center point between outlet ends 96*a*, 96*b* than proximate outlet ends 96*a*, 96*b*.

Figure 9:
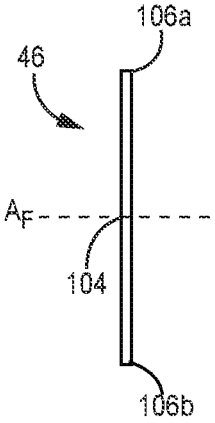
FIG. 9 is a top-down cross-sectional projection of an inlet orifice.

FIG. 9 is a top-down cross-sectional projection of inlet orifice 46. Inlet orifice 46 is flat relative to the upstream and downstream directions. Inlet orifice 46 is not curved in the upstream or downstream direction. A bottom dead center position 104 of inlet orifice 46 is axially aligned with the edges 106*a*, 106*b* of inlet orifice 46.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A spray tip for spraying fluid, the spray tip comprising:

a body having a tip bore extending transversely through the body along a flow axis;

a pre-orifice piece located within the tip bore, the pre-orifice piece having a pre-orifice channel extending therethrough, the pre-orifice piece having:

an inlet orifice open on an upstream face of the pre-orifice piece and extending partially axially through the pre-orifice piece from the upstream face;

an expansion portion of the pre-orifice channel extending in a downstream direction from the inlet orifice, the expansion portion widening relative to the inlet orifice as the expansion portion extends in a first axial direction along the flow axis away from the inlet orifice;

a turbulation chamber disposed downstream of the expansion portion to receive flow from the expansion portion, the turbulation chamber having a larger width than an outlet of the expansion portion; and a tip piece located at least partially within the tip bore, the tip piece spaced in the first axial direction along the tip bore relative to the pre-orifice piece, the tip piece having an outlet orifice formed through an inner domed surface of the tip piece downstream of the turbulation chamber and configured to atomize fluid into a spray fan, the outlet orifice comprising:

an outlet orifice major dimension between a first end of the outlet orifice and a second end of the outlet orifice; and an outlet orifice minor dimension between a first side of the outlet orifice and a second side of the outlet orifice, the outlet orifice minor dimension smaller than the outlet orifice major dimension such that the outlet orifice is non-circular, wherein:

the tip piece and the pre-orifice piece together form at least part of a fluid path extending through the tip bore;

the inlet orifice defines a first smallest flow area portion of the fluid path and the outlet orifice define a second smallest flow area portion of the fluid path;

a cross-sectional area of the inlet orifice is less than a cross-sectional area of the outlet orifice; and a first radial dimension of the inlet orifice is larger than the outlet orifice minor dimension and smaller than the outlet orifice major dimension such that a projection of the inlet orifice overlaps with the inner domed surface through which the outlet orifice is formed.

2. The spray tip of claim 1, wherein the inlet orifice is defined by a flat circle perpendicular to a flow axis through the tip bore, and wherein the outlet orifice is three-dimensional along the flow axis.

3. The spray tip of claim 2, wherein a lip of the outlet orifice is curved through three dimensions along a side extending between a first lateral end of the outlet orifice and a second lateral end of the outlet orifice.

4. The spray tip of claim 1, wherein a functional-flow cross-sectional area of the inlet orifice is smaller than a functional-flow cross-sectional area of the outlet orifice.

5. The spray tip of claim 1, further comprising:

a spacer disposed axially between the spray tip and the pre-orifice piece, wherein the spacer defines at least a portion of the turbulation chamber disposed between the inlet orifice and the outlet orifice.

6. The spray tip of claim 1, further comprising:

a retainer disposed within the tip bore and upstream of both of the tip piece and the pre-orifice piece, wherein the retainer engages the body within the tip bore to retain the tip piece and the pre-orifice piece within the tip bore.

7. The spray tip of claim 6, wherein the tip bore defines a stop and the tip piece includes a shoulder, wherein the shoulder engages the stop to define an axial position of the tip piece.

8. The spray tip of claim 7, wherein the tip piece includes a domed outlet end extending axially beyond the shoulder.

9. The spray tip of claim 1, wherein:

the tip piece includes an outlet end having a domed outer surface and the domed inner surface.

10. The spray tip of claim 9, wherein the outlet orifice is curved along the flow axis and is curved about the flow axis.

11. The spray tip of claim 1, wherein the inlet orifice further comprises:

a second radial dimension;

wherein the first radial dimension is a major dimension between a first end of the inlet orifice and a second end of the inlet orifice;

wherein the second radial dimension is a minor dimension between a first side of the inlet orifice and a second side of the inlet orifice; and wherein the first radial dimension is larger than the second radial dimension such that the inlet opening is non-circular.

12. The spray tip of claim 1, wherein the tip piece includes:

a V-shaped cut extending into an outlet end of the tip piece;

wherein the outlet orifice is defined by the V-shaped cut.

13. The spray tip of claim 1, wherein the body is a cylindrical body.

14. The spray tip of claim 13, further comprising:

a handle attached to the cylindrical body.

15. A spray gun comprising:

a gun body;

a handle extending relative to the gun body;

a trigger spaced from the handle and configured to control spraying by the spray gun;

a nozzle holder supported by the gun body; and the spray tip of claim 1 configured to be disposed at least partially within the nozzle holder.

* * * * *